US009978188B2

(12) United States Patent
Oda et al.

(10) Patent No.: US 9,978,188 B2
(45) **Date of Patent: *May 22, 2018**

(54) VEHICLE ELECTRONIC CONTROL DEVICE AND SYSTEM WITH OFF-BOARD DIAGNOSTIC FUNCTION

(71) Applicant: DENSO CORPORATION, Kariya, Aichi-pref. (JP)

(72) Inventors: Shinichiro Oda, Kariya (JP); Hiroyuki Enomoto, Kariya (JP)

(73) Assignee: DENSO CORPORATION, Kariya (JP)

( * ) Notice: Subject to any disclaimer, the term of this patent is extended or adjusted under 35 U.S.C. 154(b) by 155 days.

This patent is subject to a terminal disclaimer.

(21) Appl. No.: 15/003,971

(22) Filed: Jan. 22, 2016

(65) Prior Publication Data

US 2016/0225197 A1 Aug. 4, 2016

(30) Foreign Application Priority Data

Jan. 29, 2015 (JP) ..... 2015-15860

(51) Int. Cl.
*G07C 5/00* (2006.01)

(52) U.S. Cl.
CPC ..... *G07C 5/008* (2013.01); *G07C 2205/02* (2013.01)

(58) Field of Classification Search
None
See application file for complete search history.

(56) References Cited

U.S. PATENT DOCUMENTS

| | | | | |
|---|---|---|---|---|
| 5,038,289 | A | 8/1991 | Abe | |
| 5,200,745 | A | 4/1993 | Takai et al. | |
| 6,285,931 | B1 * | 9/2001 | Hattori | G07C 5/008 340/426.15 |
| 2001/0037168 | A1 | 11/2001 | Hozuka et al. | |
| 2006/0259209 | A1 * | 11/2006 | Sugimura | G01R 31/3278 701/1 |

(Continued)

FOREIGN PATENT DOCUMENTS

| | | | |
|---|---|---|---|
| JP | H04-21945 | U | 2/1992 |
| JP | H07-046676 | A | 2/1995 |

(Continued)

OTHER PUBLICATIONS

U.S. Appl. No. 15/003,937, filed Jan. 22, 2016, Oda et al.

*Primary Examiner* — John Olszewski
*Assistant Examiner* — Navid Ziaeianmehdizadeh
(74) *Attorney, Agent, or Firm* — Posz Law Group, PLC

(57) ABSTRACT

An electronic control device (ECU) refrains from a transmission of a requested diagnosis data while IGSW is turned ON in case that an external device is connected to a dedicated connector. After turning OFF of IGSW, regardless of the connection of the external device to the connector, the transmission of the requested diagnosis data to the center is performed. As a result, a delay of an off-board diagnosis process in the ECU due to the transmission of the diagnosis data is prevented. Further, the data required for performing a remote diagnosis service is regularly transmitted to a management center. Therefore, the remote diagnosis service is performable when a commercially-available external device is connected to the dedicated connector by a user of a vehicle.

14 Claims, 5 Drawing Sheets

(56) References Cited

U.S. PATENT DOCUMENTS

| | | | | |
|---|---|---|---|---|
| 2008/0161989 | A1* | 7/2008 | Breed | B60J 10/00 701/31.4 |
| 2008/0180676 | A1 | 7/2008 | Tsai | |
| 2008/0284575 | A1* | 11/2008 | Breed | B60C 23/0493 340/438 |
| 2011/0093159 | A1* | 4/2011 | Boling | G06Q 10/06 701/29.6 |
| 2013/0345903 | A1* | 12/2013 | Nakagawa | G07C 5/008 701/2 |
| 2014/0052531 | A1* | 2/2014 | Kent | G06Q 30/02 705/14.49 |
| 2015/0281022 | A1 | 10/2015 | Harata et al. | |
| 2016/0225196 | A1 | 8/2016 | Oda et al. | |

FOREIGN PATENT DOCUMENTS

| | | | |
|---|---|---|---|
| JP | H09-021866 | A | 1/1997 |
| JP | H09-210866 | A | 8/1997 |
| JP | 2006-128807 | A | 5/2006 |

* cited by examiner

VEHICLE ELECTRONIC CONTROL DEVICE AND SYSTEM WITH OFF-BOARD DIAGNOSTIC FUNCTION

CROSS REFERENCE TO RELATED APPLICATION

The present application is based on and claims the benefit of priority of Japanese Patent Application No. 2015-015860, filed on Jan. 29, 2015, the disclosure of which is incorporated herein by reference.

TECHNICAL FIELD

The present disclosure generally relates to an electronic control device disposed in a vehicle and having an off-board diagnosis function that is performed in response to a request from an external diagnosis device, and an electronic control system having such an electronic control device.

BACKGROUND INFORMATION

Conventionally, as disclosed in a Japanese Patent Laid-Open No. H07-46676 (patent document 1), an electronic control device installed in a vehicle, or an in-vehicle Electronic Control Unit (ECU), performs, in cooperation with an external diagnosis device (i.e., a so-called diagnosis tool), an off-board diagnosis of a vehicle, in response to a request from the external diagnosis device. In such an off-board diagnosis, a read-out instruction is sent from the diagnosis tool to the in-vehicle ECU to read out various failure diagnosis data including a result of an on-board diagnosis or to control the vehicle devices for various operations that are not usually performed, in order to perform a high-level diagnosis.

Further, in recent years, vehicle manufactures sometimes provide a remote diagnosis service for the vehicle user. The remote diagnosis service may, for example, collect data such as a travel distance, a failure diagnostic data, warning information, and the like from each vehicle to send to a management center via a data communication, and may send a notice to the user based on the collected data that it is about time for the vehicle to have a regular checkup in a service shop, for example.

When the off-board diagnosis is performed in response to a request from the diagnosis tool, the diagnosis tool is connected to a dedicated connector, and the request is sent in a message form to the in-vehicle ECU via a dedicated connector. The in-vehicle ECU sends back a response message to the diagnosis tool within a preset period of time, after receiving a request message. The diagnosis tool determines that an abnormality is being caused regarding a communication with the in-vehicle ECU, if the tool does not receive the response message within the preset period of time.

Therefore, to provide the remote diagnosis service described above, a special care is required to not delay a process of the off-board diagnosis that is performed based on the request from the diagnosis tool. Therefore, to prevent such a delay, when the diagnosis tool is connected to the dedicated connector, the in-vehicle ECU may be configured not to perform a process about the remote diagnosis service.

However, a publicly-sold display device is connectable to the dedicated connector for reading various kinds of vehicle information (e.g., for reading a fuel mileage, an average speed, water temperature etc.) and the user can purchase such a device in an aftermarket. The display device is, in principle, connected to the dedicated connector all the time, for the reading of the vehicle information. On the in-vehicle ECU side, it is difficult to distinguish whether the connector is connected to the diagnosis tool or to the display device. Therefore, if the in-vehicle ECU is configured not to perform the process about the remote diagnosis service when an external device is connected to the dedicated connector, the data required for the remote diagnosis service is not transferrable from the vehicle to the management center when the user connects the above-described display device to the dedicated connector.

SUMMARY

It is an object of the present disclosure to provide an ECU that is capable of transmitting required data for a remote diagnosis service even when a vehicle user connects a publicly-sold (i.e., commercial) external tool to a dedicated connector, and an electronic control system having such an ECU.

In one aspect of the present disclosure, an electronic control device installed in a vehicle for performing a predetermined control process, the electronic control device includes an off-board diagnoser performing an off-board diagnosis in response to a request from an external device that is connected to a dedicated connector providing a connection to the external device, and a diagnosis data transmitter (i) generating a diagnosis data to be transmitted to an external management center, and (ii) transmitting the generated diagnosis data to the external management center. Operation of the electronic control device is continued by receiving a power supply after a turning OFF of an ignition switch of the vehicle. Also, in case that the external device is connected to the connector, the diagnosis data transmitter is configured to (a) refrain from transmitting the diagnosis data to the external management center while the ignition switch of the vehicle is turned ON, and (b) transmit the diagnosis data after the turning OFF of the ignition switch.

As described above, the electronic control device, or ECU according to the present disclosure refrains from transmitting the diagnosis data to the external management center while the ignition switch is turned ON, in case that the external device is connected to the connector. Therefore, when a diagnosis tool is connected to the connector and an off-board diagnosis is performed, a delay of an off-board diagnosis process in ECU is prevented.

On the other hand, after turning OFF of the ignition switch, ECU does not have to respond to a request from the external device that is connected to the connector. Therefore, ECU according to the present disclosure is configured to receive a power supply continuously after the turning OFF of the ignition switch, which make ECU continuously operable after such turning OFF of the switch, thereby enabling ECU to transmit the diagnosis data after the turning OFF of the switch. Thus, the data required for the remote diagnosis service is transmitted to the management center.

In another aspect of the present disclosure, an electronic control system including an electronic control device installed in a vehicle for performing a predetermined control process, the control system includes an off-board diagnoser performing an off-board diagnosis in response to a request from an external device that is connected to a dedicated connector providing a connection to the external device a communicator communicating with an external management center a diagnosis data transmitter (i) generating a diagnosis data and (ii) transmitting the generated diagnosis data to the external management center by using the communicator, and a power supplier supplying an electric power to the electronic control system, the supply of the electric power is continued after a turning OFF of an ignition switch (2) of the vehicle. The diagnosis data transmitter is configured to refrain from transmitting the diagnosis data to the external management center while the ignition switch of the vehicle is turned ON, and transmit the diagnosis data after the turning OFF of the ignition switch, when the external device is connected to the connector.

In such a configuration of the electronic control system, the same effects as described in the above for ECU are achieved.

The numerals in the above are intended to exemplify a relationship between the claimed elements and the configuration in the embodiment, and not restricting the scope of the disclosure in any manner.

Further, other technical features in each of the claims other than one described above may become apparent based on the description of the embodiments and based on the attached drawings.

BRIEF DESCRIPTION OF THE DRAWINGS

Objects, features, and advantages of the present disclosure will become more apparent from the following detailed description made with reference to the accompanying drawings, in which.

DETAILED DESCRIPTION

First Embodiment

Hereafter, the first embodiment of present disclosure is described based on the drawings.

Figure 1:
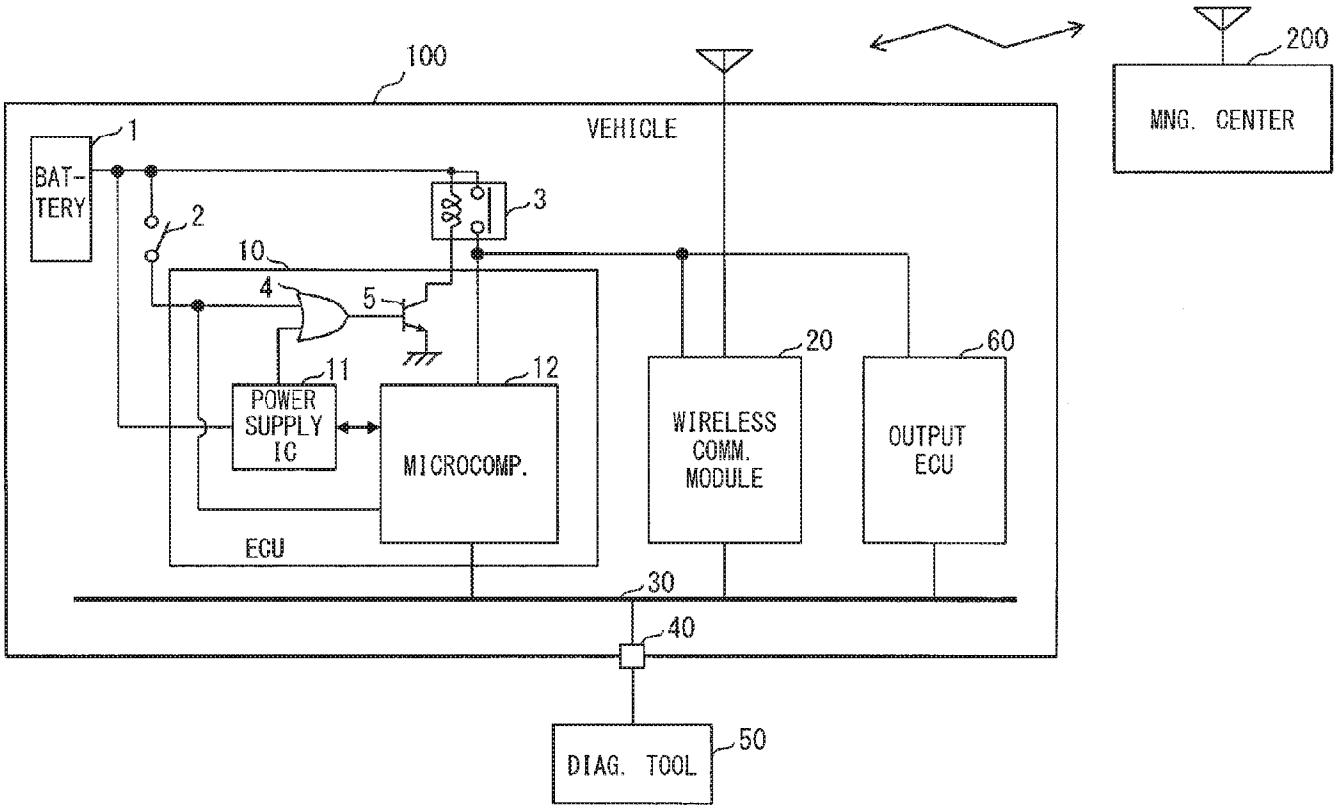
FIG. 1 is a block diagram of a configuration of an electronic control system in a first embodiment of the present disclosure.

FIG. 1 is a block diagram of a configuration of an electronic control system concerning the present embodiment.

The electronic control system of the present embodiment has an electrical control device (ECU) 10 and a wireless the communication module 20.

ECU 10 and the communication module 20 are disposed on a vehicle 100, for example, and are mutually connected via a communication bus 30 of an in-vehicle network which operates based on a communications protocol, such as a Controller Area Network (CAN). Therefore, ECU 10 and the communication module 20 are mutually communicable via communication bus 30.

A dedicated connector 40, which is capable of providing a connection to the external devices (e.g., a diagnosis tool 50), is connected to the communication bus 30. The dedicated connector 40 is disposed at a lower part of a dashboard around the driver's seat, for example. When the diagnosis tool 50 is connected to the dedicated connector 40, the diagnosis tool 50 becomes communicable with ECU 10 via communication bus 30 and the dedicated connector 40. Although not illustrated, the dedicated connector 40 has a mechanical switch for detecting that an external device including the diagnosis tool 50 is connected to the dedicated connector 40.

Further, the communication bus 30 also has an output ECU 60 connected thereto, beside ECU 10. The output ECU 60 may, for example, perform a control process and the like for controlling a control object device that is a different device from the control object device of ECU 10. Further, the output ECU 60 outputs, on behalf of an external management center 200, a transmission request of the diagnosis data to ECU 10, when an ignition switch (IGSW) 2 is turned OFF after a travel of the vehicle 100 (i.e., when the vehicle 100 is stopped).

The wireless communication module 20 is capable of performing communication with the management center 200 by wireless communication, which uses a portable telephone network, for example. An example of communication between the wireless communication module 20 and the management center 200 is described below.

First, the wireless communication module 20 receives a request from management center 200, which request a transmission of diagnosis data. In this case, the wireless communication module 20 outputs a received request to transmit the diagnosis data to ECU 10. According to the transmission request, ECU 10 generates the requested diagnosis data generated diagnosis data is outputted to the wireless communication module 20. The wireless communication module 20 transmits the diagnosis data to the management center 200, upon receiving the diagnosis data from ECU 10.

Thereby, the management center 200 obtains various kinds of vehicle information (e.g., a travel distance, data for failure diagnoses, warning information, etc.) as the diagnosis data. Further, for example, based on the obtained vehicle information, the management center 200 determines a suitable maintenance timing of a corresponding vehicle, and notifies the vehicle user of the maintenance timing.

The maintenance timing notice may be provided by using the wireless communication module 20, or may be transmitted to the user's cellular phone (e.g., to a smart phone), a personal computer, etc. in the form of an e-mail.

In the electronic control system including ECU 10, the diagnosis tool 50 is used for performing an off-board diagnosis. ECU 10 has a self-diagnosis function for determining whether the ECU 10 itself and its peripheral circuit, as well as sensors and actuators, are normally operating based on an execution of a built-in software, and for recording the diagnosis results and related data (i.e., failure diagnosis data), which may also be designated as an on-board diagnosis function. The off-board diagnosis is performed as (i) a read-out and a transmission of the failure diagnosis data derived from the on-board diagnosis and (ii) a special operation of a control object device or the like performed for a high-level diagnosis together with a transmission of resulting data of such special operation.

Therefore, the diagnosis tool 50 transmits to ECU 10 a request message that requests a read-out of the failure diagnosis data, and an execution of a special operation. Then, according to the request message, ECU 10 reads the failure diagnosis data and detects operation-related data regarding the special operation. Then. ECU 10 transmits the response message that includes the data, and proof of an execution of the requested diagnosis operation to the diagnosis tool 50.

The diagnosis tool 50 measures a lapse time after a transmission of the request message until it receives the response message. When the measured lapse time reaches a preset value without receiving the response message, the diagnosis tool 50 determines that a certain abnormality is caused in communication with ECU 10, for example. Therefore, ECU 10 is required to transmit the response message in response to the request message within a predetermined time after receiving the request message.

ECU 10 is provided with a power supply IC 11 and a microcomputer 12.

The power supply IC 11 is an Integrated Chip (IC) for controlling a state of a power relay 3 which provides a power supply to ECU 10, to the wireless communication module 20, and to the output ECU 60.

The microcomputer 12 has a well-known configuration including Central Processing Unit (CPU), memories (e.g., Read Only Memory (ROM), Random Access Memory (RAM), Electrically Erasable Programmable Read-Only Memory (EEPROM), etc.), a communication interface, a bus line that connects the above elements. In addition, the microcomputer 12 is configured to perform, besides performing predetermined control processes, (i) an off-board diagnosis process based on the request message from the diagnosis tool 50, and (ii) a generation process and a transmission process of the diagnosis data based on a request from the management center.

Further, the microcomputer 12 is electrically connected to a battery 1 disposed in the vehicle 100 via IGSW 2. Therefore, an ignition (IG) signal that shows an ON and OFF of IGSW 2 is inputted to the microcomputer 12. Based on the IG signal, the microcomputer 12 can detect whether IGSW 2 is ON or OFF.

Further, the output ECU 60 also receives an input of the IG signal, for detecting the turning OFF of IGSW 2. Alternatively, the microcomputer 12 in ECU 10 may be configured to notify the output ECU 60 about the turning OFF of IGSW 2 via communication bus 30.

The power supply IC 11 always receives a power supply from the battery 1, and the power supply IC 11 is operable even when IGSW 2 is turned OFF. However, the power supply to the power supply IC 11 may be provided from the power relay 3 that is mentioned later.

The output signal of the power supply IC 11 is inputted to an OR circuit 4. Also, an IG signal is inputted to the OR circuit 4 via IGSW 2. Further, an output of the OR circuit 4 is connected to a base of a transistor 5 that is connected to a coil of the power relay 3. Therefore, when a high-level signal is outputted from the OR circuit 4, the transistor 5 is turned ON. Then, an electric current flows to the coil of the relay 3, and a contact of the relay 3 is turned ON. On the other hand, when a low-level signal is outputted from the OR circuit 4, the transistor 5 is turned OFF. Therefore, the power supply to the coil of the relay 3 stops, and the contact of the relay 3 is turned OFF.

In the example shown in FIG. 1, although the OR circuit 4 and the transistor 5 are disposed in an inside of ECU 10, these components may also be disposed at an outside of ECU 10.

Here, the power supply to ECU 10, to the communication module 20 and to the output ECU 60 is described.

First, when IGSW 2 is turned ON, an IG signal is input to the OR circuit 4. According to the input of the IG signal, the OR circuit 4 outputs a high-level signal. Therefore, the contact of the relay 3 is turned ON and the power supply to ECU 10, to the communication module 20 and to the output ECU 60 is started.

When the power supply to ECU 10 is started, the microcomputer 12 instructs the power supply IC 11 to output a high-level signal. Thereby, even when IGSW 2 is turned off, the OR circuit 4 maintains (i.e., keeps on outputting) the high-level signal, which prevents an immediate shut-down of the power supply to ECU 10, to the communication module 20 and to the output ECU 60 immediately after a turning OFF of IGSW 2.

When the microcomputer 12 detects that IGSW 2 is turned OFF based on an input of the IG signal, the microcomputer 12 instructs the power supply IC 11 to output the low-level signal after a preset time from such detection. Based on such instruction, the power supply IC 11 starts time measurement, and after the lapse of the preset time, the IC 11 switches the output signal from the high level to the low level. Therefore, after a turning OFF of IGSW 2, the power supply is maintained (i.e., is kept uninterrupted) for the preset time, and ECU 10 and the communication module 20 as well as the output ECU 60 are kept in an operable state. Further, the length of the predetermined time mentioned above is pre-defined as a period of time (e.g., 30 seconds) that is sufficient for ECU 10 to prepare the diagnosis data and to transmit the data in response to the transmission request from the output ECU 60.

In the electronic control system having the above-described configuration, when the diagnosis tool 50 is connected to the dedicated connector 40, the microcomputer 12 receives the request message from the diagnosis tool 50. After receiving the request message, the microcomputer 12 is required to transmit, without delay, the response message based on performing the requested diagnosis operation and/or preparing the required data. Therefore, when the external device is connected to the dedicated connector 40, the electronic control system concerning the present embodiment is configured to refrain a transmission of the diagnosis data to the management center 200, even if the microcomputer 12 receives a transmission request of the diagnosis data from the management center 200, for not causing a delay of the off-board diagnosis process in ECU 10. Details of such configuration are described later.

Here, the diagnosis tool 50 is connected to the dedicated connector 40 when performing the off-board diagnosis of the electronic control system. Therefore, the connection of the tool 50 to the connector 40 is usually only temporary (i.e., only for a short period of time). Therefore, in case that the diagnosis tool 50 is the only device that is connected to the dedicated connector 40, even if the transmission of the diagnosis data to the management center 200 is not performed for such a short period of time, it will not cause a problem in particular.

However, in recent years, various kinds of information, including the fuel mileage, an average speed, water temperature, are read out by a display device that is sold publicly. The device is connected to the system via dedicated connector 40, and such a display device is usually connected to the connector 40 all the time (i.e., for a long time). On the electronic control system side, it is difficult to distinguish whether the external device connected to the connector 40 is the diagnosis tool 50, or the publicly-sold display device. Therefore, simply prohibiting a transmission of the diagnosis data to the management center 200 in response to the transmission request when an external device is connected to the dedicated connector 40 will not work. That is, in such prohibition scheme, when the user connects the publicly-sold display device to the dedicated connector 40, the diagnosis data is not transmittable from the vehicle 100 to the management center 200 at all. In such case, the remote diagnosis service may not be provided for the user.

Therefore, in the electronic control system concerning the present embodiment, in case that the external device is connected to the dedicated connector 40, while IGSW 2 is turned ON, a process for the transmission of the requested diagnosis data is not performed (i.e., is refrained), and after IGSW 2 is turned OFF, the transmission process of the requested diagnosis data is performed.

In other words. ECU 10 is configured to respond to the transmission request of the diagnosis data that is received from the management center 200, only in the following occasions (i.e., (i) when the external device is not connected to the connector 40 or (ii) after the turning OFF of IGSW 2). Therefore, when the diagnosis tool 50 is connected to the dedicated connector 40 and the off-board diagnosis is performed, a delay of the off-board diagnosis process in ECU 10 due to the transmission process of the diagnosis data is prevented from happening.

On the other hand, after IGSW 2 is turned OFF, even if the external device connected to the dedicated connector 40 is the diagnosis tool 50, ECU 10 is not required to respond to the request from the external device. Therefore, the transmission process of the requested diagnosis data by ECU 10 is configured to be performable in response to the request from the management center 200, after IGSW 2 is turned OFF, regardless of the connection of the external device to the dedicated connector 40.

However, the electronic control system does not always receive the transmission request from the management center 200 at an every turning OFF timing of IGSW 2. Therefore, in the present embodiment, the output ECU 60 is, on behalf of the management center 200, configured to output the transmission request of the diagnosis data when IGSW 2 is turned OFF. In such manner, the data required for the remote diagnosis service is transmittable to the management center 200 regularly and securely.

Figure 2:
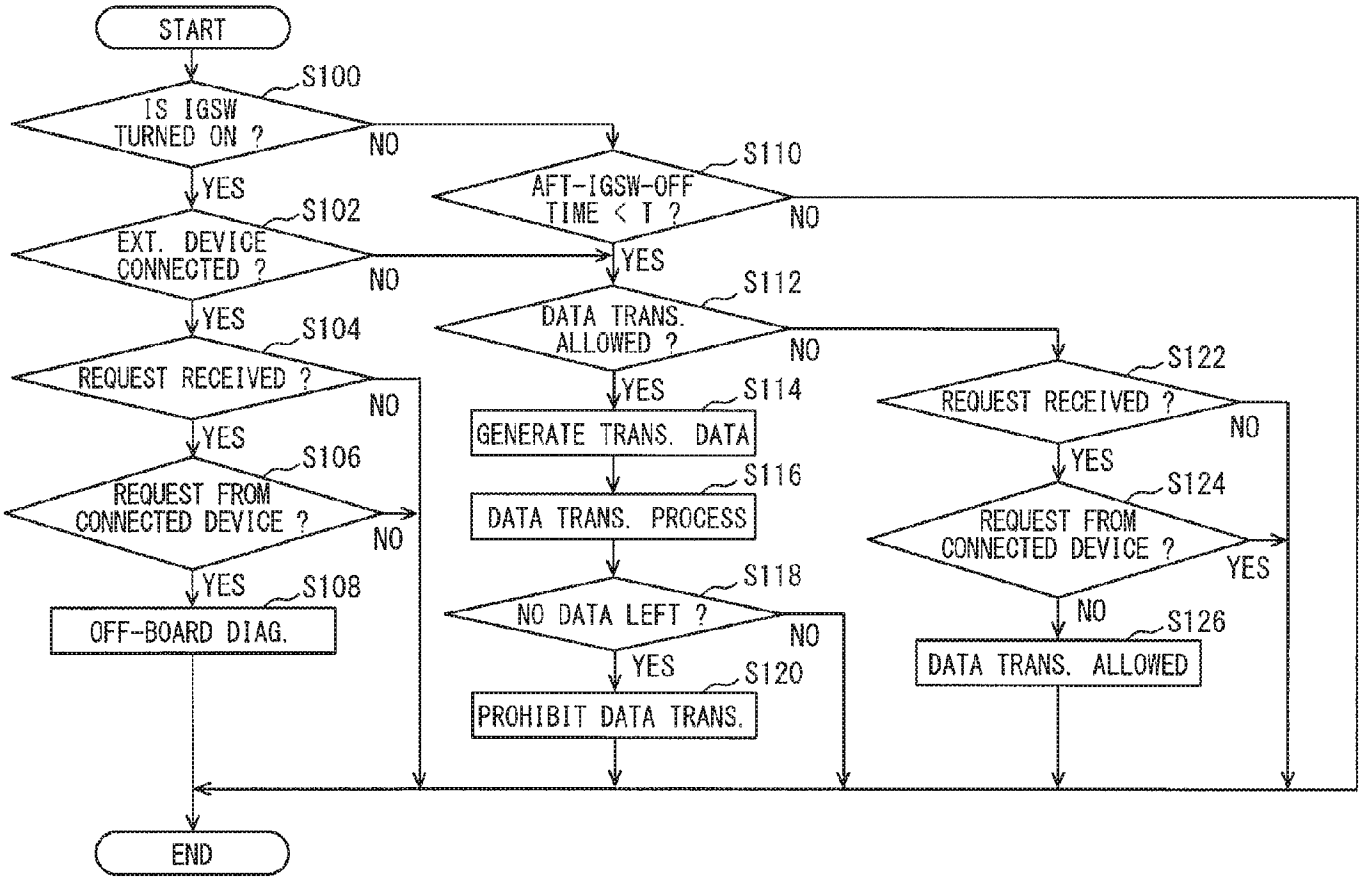
FIG. 2 is a flowchart of an arbitration process for arbitrating an off-board diagnosis process and a transmission process of diagnosis data in the electronic control system in the first embodiment of the present disclosure.

The process for arbitrating the off-board diagnosis process and the transmission process of the diagnosis data which are mentioned above is described in more details with reference to a flowchart in FIG. 2. The process shown in the flowchart or FIG. 2 is repeatedly performed in ECU 10 at predetermined intervals.

In Step S100, it is determined whether IGSW 2 is turned ON based on the IG signal. When it is determined that IGSW 2 is turned ON, the process proceeds to Step S102. When it is determined that IGSW 2 is turned OFF, the process proceeds to Step S110.

In Step S102, it is determined whether an external device is connected to the dedicated connector 40. When it is determined that the external device is connected to the dedicated connector 40, the process proceeds to Step S104. When it is determined that the external device is not connected to the dedicated connector 40, the process proceeds to Step S112.

In Step S104, it is determined whether a request from the external device connected to the dedicated connector 40 or from the management center 200 is received. When it is determined that a request is received (S104: YES), the process proceeds to Step S106, and, when it is determined that a request is not received (S104: NO), the process of the flowchart in FIG. 2 is finished at once.

In Step S106, it is determined whether the received request is coming from the external device connected to the dedicated connector 40. In this determination process, when it is determined that the received request is coming from the external device connected to the dedicated connector 40 (S106: YES), the process proceeds to Step S108. On the other hand, when it is determined that the received request is coming from the management center 200 (S106: NO), the process of the flowchart in FIG. 2 is finished at once. In other words, when IGSW 2 is turned ON and the external device is connected to the dedicated connector 40, ECU 10 does not respond to the transmission request of the diagnosis data from the management center 200, even when such a request is received by ECU 10.

In Step S108, an off-board diagnosis process is performed. That is, the failure diagnosis data is read out according to the request message from the external device or, while performing the special operation of the control object device, the operation-related data regarding the special operation is detected. Then, a response message that includes the data as well as a proof of execution of the requested diagnosis operation is transmitted back to the external device.

On the other hand, in Step S110, which is performed when it is determined that IGSW 2 is turned OFF, it is determined whether a lapse time after IGSW 2 is turned OFF is less than a predetermined time T. That is, ECU 10 measures the lapse time after IGSW 2 is turned OFF by using an internal timer or the like, and determines if the lapse time has reached the predetermined time T or not. In this determination process, when it is determined that the lapse time is less than the predetermined time T, the process proceeds to Step 3112. On the other hand, when it is determined that the lapse time is equal to or greater than the predetermined time T, the process of flowchart in FIG. 2 is finished at once.

In Step S112, it is determined whether a data transmission flag which shows permission or prohibition of transmission of the diagnosis data to the management center 200 is set to "allowed."

When the flag is set to "allowed," the process proceeds to Step S114, and, when the flag is set to "prohibition," the process proceeds to Step S122.

The data transmission flag is initially set to "prohibition" as an initial value.

In Step S114, since the data transmission flag is set to "allowed", the requested diagnosis data is read out from the memory or the data is detected by the sensor or the like, and a data generation process which generates the transmission data is performed. Then, in Step S116, the transmission process of the generated transmission data is performed. That is, ECU 10 outputs, according to the request, the generated transmission data to the communication module 20, and controls the communication module 20 to transmit the transmission data to the management center 200.

Then, in Step S118, it is determined whether transmission of all transmission data which should be transmitted is complete. When it is determined that transmission of all transmission data is complete, the process proceeds to Step S120.

When it is determined that, on the other hand, the diagnosis data which should still be transmitted is left, the process of the flowchart in FIG. 2 is finished at once. In this case, when the process of the flowchart in FIG. 2 is performed next time, transmission of the un-transmitted transmission data will be performed.

Then, in Step S120, since transmission of all transmission data is complete, the data transmission flag is changed to "prohibition" from "allowed."

In Step S122, which is performed when the data transmission flag determined in Step S112 is "prohibition", it is determined whether the request from the external device connected to the dedicated connector 40 or from the management center 200 is received. When it is determined that the request is received, the process proceeds to Step S124, and, when it is determined that the request is not received, the process of the flowchart in FIG. 2 is finished at once.

In Step S124, it is determined whether the received request is coming from the external device connected to the dedicated connector 40. In this determination process, when it is determined that the received request is coming from the external device connected to the dedicated connector 40, the process of the flowchart in FIG. 2 is finished at once. On the other hand, when it is determined that the received request is coming from the management center 200, the process proceeds to Step S126.

The data transmission flag is set to "allowed" in Step S126. By setting the flag to "allowed," when the process of the flowchart in FIG. 2 is performed next time, the determined result in Step S112 comes out as "YES," and the data transmission process will be performed in Step S116.

Note that "the request from the management center 200" in the above description of the flowchart in FIG. 2 not only indicates the actual request from the management center 200, but also indicates the request that is output from the output ECU 60.

As mentioned above, when IGSW 2 is turned ON and the external device is connected to the dedicated connector 40, even when ECU 10 receives a transmission request from the management center 200, ECU 10 in the present embodiment does not perform the transmission of the diagnosis data. Therefore, when the external device connected to the dedicated connector 40 is the diagnosis tool 50, and when the off-board diagnosis is performed, a delay of the off-board diagnosis process is prevented as much as possible.

However, even when IGSW 2 is turned ON, when the external device is not connected to the dedicated connector 40, the determined result in Step S102 of the flowchart of FIG. 2 comes out as "NO," and the process proceeds to Step S112. Therefore, when the external device is not connected to the dedicated connector 40, even when IGSW 2 is turned ON, ECU 10 performs the transmission process of the diagnosis data according to the request from the management center 200.

Further, in the present embodiment, after IGSW 2 is turned OFF, ECU 10, the communication module 20, and the output ECU 60 are operable by continuously receiving the power supply for at least a preset amount of time. Then, based on a turning OFF of IGSW 2, the output ECU 60 outputs, on behalf of the management center 200, the transmission request of the diagnosis data. In response to the transmission request, ECU 10 performs the transmission process of the diagnosis data as the process of Step S114 and Step S116. Therefore, even in case that the commercial display device is always connected to the dedicated connector 40, the data required for the remote diagnosis service is regularly transmitted to the management center 200.

In the first embodiment mentioned above, when IGSW 2 is turned OFF, an example configuration is provided as an on-behalf transmission scheme, in which the output ECU 60 on behalf of the management center 200 outputs the transmission request of the diagnosis data. However, when ECU 10 detects that IGSW 2 is turned OFF, it is also possible to program ECU 10 to transmit the predetermined diagnosis data to the management center 200 without receiving any request from other ECUs. In such case, it is not necessary for ECU 10 to receive the transmission request of the diagnosis data from the output ECU 60.

Second Embodiment

The second embodiment of the present disclosure is described. Since the electronic control system concerning the second embodiment is configured just like the electronic control system in the first embodiment, the description about configuration is omitted from the second embodiment.

According to the first embodiment mentioned above, when it is detected that IGSW 2 is turned OFF based on an input of the IG signal, the microcomputer 12 of ECU 10 instructs the power supply IC 11 to change the output signal to the low level after a lapse of the preset time.

On the other hand, in the present embodiment, the microcomputer 12 is configured to determine a stop timing of the power supply, and, when it is determined that such a stop timing has arrived, the microcomputer 12 is configured to output a stop instruction to the power supply IC 11 for stopping the power supply from the power supply IC 11.

Figure 3:
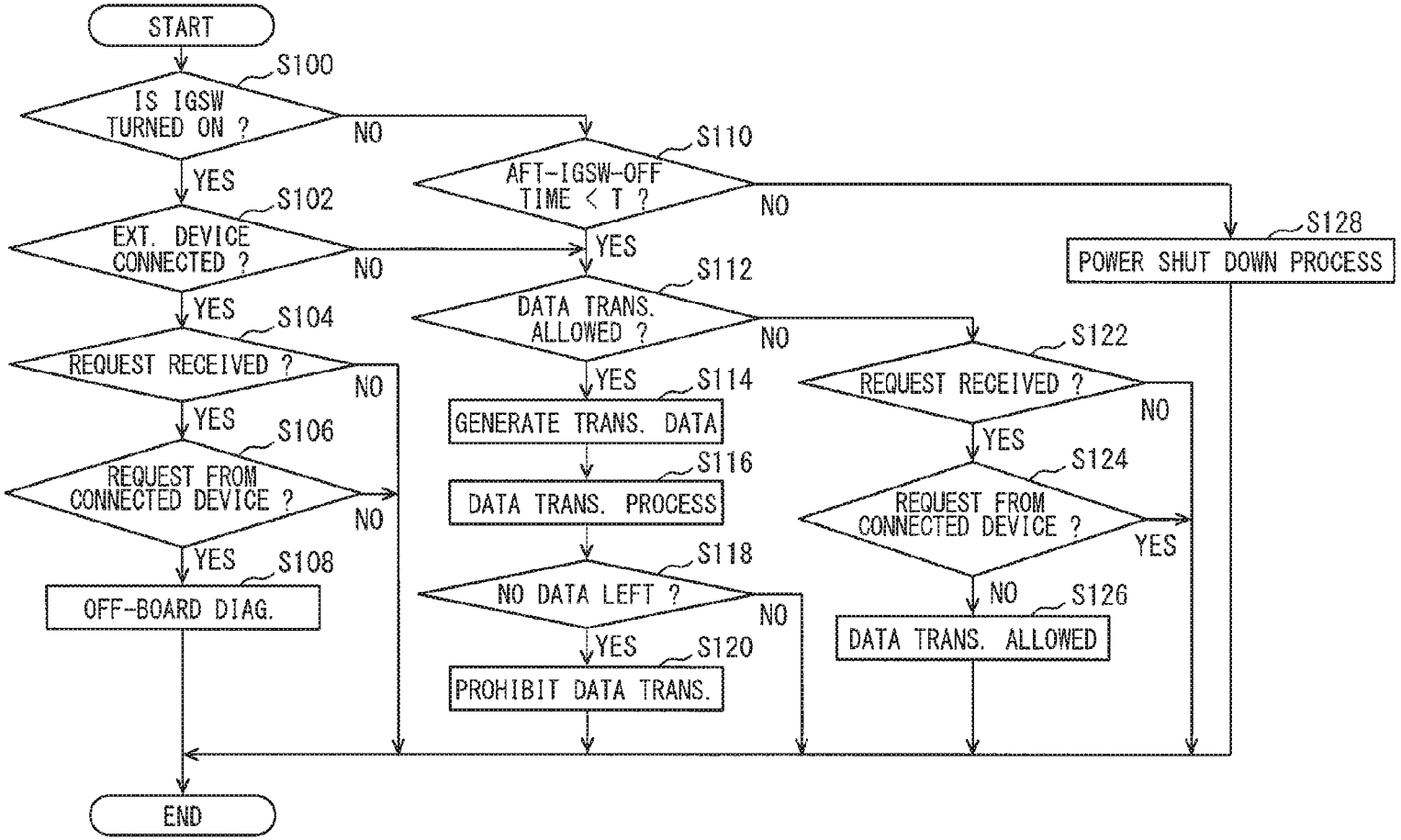
FIG. 3 is a flowchart of the arbitration process for arbitrating the off-board diagnosis process and the transmission process of the diagnosis data in a second embodiment of the present disclosure.

As specifically shown in a flowchart in FIG. 3, when it is determined that the lapse time after a turning OFF of IGSW 2 is equal to or greater than the predetermined time T, instead of finishing the flowchart process at once, a power shut down process is performed in Step S128 for immediately stopping the power supply from the power supply IC 11.

Third Embodiment

The third embodiment of the present disclosure is described. Since the electronic control system in the third embodiment is configured just like the electronic control system in the first embodiment, the description about configuration is omitted from the third embodiment.

In the second embodiment mentioned above, the microcomputer 12 of ECU 10 instructs the stop of the power supply to the power supply IC 11 at a timing which is a predetermined time after a turning OFF of IGSW 2. In the present embodiment, even when the transmission of the diagnosis data is not complete for some reason, the power shut down process is not performed until transmission of all diagnosis data is complete.

Figure 4:
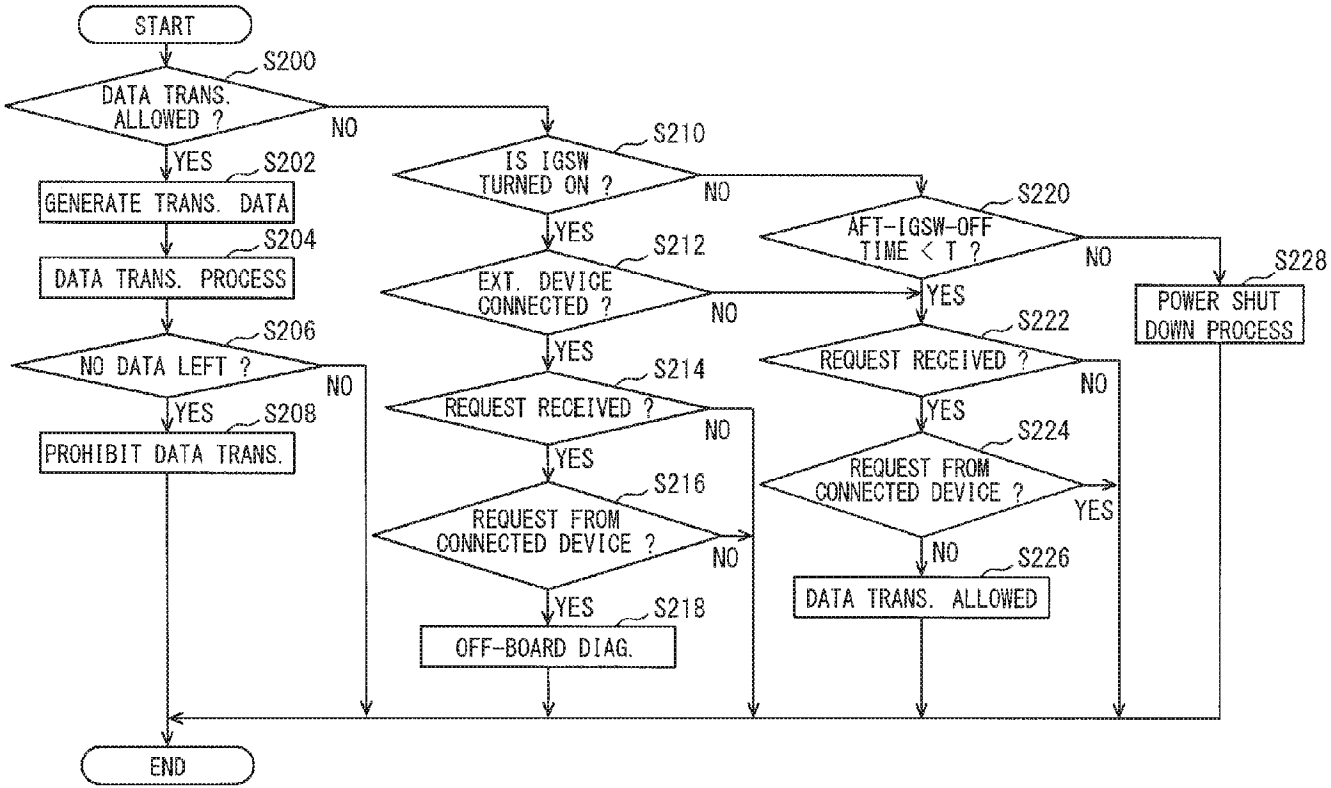
FIG. 4 is a flowchart of the arbitration process for arbitrating the off-board diagnosis process and the transmission process of the diagnosis data in a third embodiment of the present disclosure.

Hereafter, with reference to a flowchart in FIG. 4, the process for arbitrating the off-board diagnosis process and the transmission process of the diagnosis data in the present embodiment is described.

In step S200, it is determined whether the data transmission flag which shows permission of transmission of the diagnosis data to the management center 200 and prohibition is set to "allowed." When the flag is set to "allowed", the process proceeds to Step S202, and, when the flag is set to "prohibition", the process proceeds to Step S210. The data transmission flag is initially set to "prohibition" as an initial value.

In Step S202, since the data transmission flag is set to "allowed", the requested diagnosis data is read out from the memory, or the data is detected by the sensor, and the data generation process for generating the transmission data is performed. Then, in Step S204, the transmission process of the generated transmission data is performed. That is, ECU 10 outputs the transmission data, which is generated according to the request, to the communication module 20, and controls the communication module 20 to transmit the transmission data to the management center 200.

In Step S206, it is determined whether transmission of all transmission data which should be transmitted is complete. When it is determined that transmission of all transmission data is complete, the process proceeds to Step S208. When, on the other hand, it is determined that the transmission data which should still be transmitted is left, the process of the flowchart in FIG. 4 is finished at once. In this case, when the process of the flowchart in FIG. 2 is performed next time, transmission of the un-transmitted transmission data will be performed.

In Step S208, since transmission of all transmission data is complete, the data transmission flag is changed to "prohibition" from "allowed."

In Step S210, which is performed when the data transmission flag is determined as "prohibition" in Step S200, it is determined whether IGSW 2 is set to ON based on the IG signal. When it is determined that IGSW 2 is turned ON, the process proceeds to Step S212. On the other hand, when it is determined that IGSW 2 is turned OFF, the process proceeds to Step S220.

In Step S212, it is determined whether the external device is connected to the dedicated connector 40. When it is determined that the external device is connected to the dedicated connector 40, the process proceeds to Step S214. When it is determined that the external device is not connected to the dedicated connector 40, the process proceeds to Step S222.

In Step S214, it is determined whether the request from the external device connected to the dedicated connector 40 or from the management center 200 is received. When it is determined that the request is received, the process proceeds to Step S216, and, when it is determined that the request is not received, the process of the flowchart in FIG. 4 is finished at once.

In Step S216, it is determined whether the request is received from the external device connected to the dedicated connector 40 or not. In this determination process, when it is determined that the received request is coming from the external device connected to the dedicated connector 40, the process proceeds to Step S218. On the other hand, when it is determined that the received request is coming from the management center 200, the process of the flowchart in FIG. 4 is finished at once.

The off-board diagnosis process is performed in Step S218. That is, the failure diagnosis data is read out according to the request message from the external device, or, while performing a special operation of the control object device, the operation-related data of such special operation is detected. Then, the response message including the data from the read-out of the failure diagnosis and a proof of the execution of the requested diagnosis operation or from the special operation is transmitted back to the external device.

In Step S220, which is performed when IGSW 2 is determined as OFF in Step S210, it is determined whether the lapse time after IGSW 2 is turned OFF is less than the predetermined time T. In this determination process, when it is determined that the lapse time is less than the predetermined time T, the process proceeds to Step S222. On the other hand, when it is determined that the lapse time is equal to or greater than the predetermined time T, the process proceeds to Step S228.

In Step S222, it is determined whether the request from the external device connected to the dedicated connector 40 or from the management center 200 is received. When it is determined that the request is received, the process proceeds to Step S224, and, when it is determined that the request is not received, the process of the flowchart in FIG. 4 is finished at once.

In Step S224, it is determined whether the received request is coming from the external device connected to the dedicated connector 40 or not. In this determination process, when it is determined that the received request is coming from the external device connected to the dedicated connector 40, the process of the flowchart in FIG. 4 is finished at once. On the other hand, when it is determined that the received request is coming from the management center 200, the process proceeds to Step S226.

The data transmission flag is set to "allowed" in Step S226. By such setting, when the process of the flowchart in FIG. 2 is performed next time, the determined result in Step S200 comes out as "YES," and the data transmission process will be performed in Step S204.

On the other hand, in Step S228, which is performed when the lapse time after a turning OFF of IGSW 2 is determined to be equal to or greater than the predetermined time in Step S220, the power supply shut down process is performed, and the power supply IC 11 is instructed to immediately stop the power supply.

According to the flowchart in FIG. 4 mentioned above, before performing determination of the lapse time after a turning OFF of IGSW 2 (Step S220), the determination of whether the data transmission flag is set to "allowed" is performed (Step S200). Then, the data transmission flag is maintained as "allowed" until transmission of all transmission data is complete.

Therefore, when the transmission request of the diagnosis data is received after IGSW 2 is turned OFF, and the data transmission flag is set to "allowed" in Step S226, even after the lapse of the predetermined time T, the transmission process of the transmission data will be continued. Then, if transmission of all transmission data is complete, the data transmission flag is set to "prohibition" in Step S208, which controls the series of processes of the flowchart in FIG. 4 to follow a sequence of steps S200→S210→S220→S228 when performed next time, for performing a power supply shut down process.

Fourth Embodiment

The fourth embodiment of the present disclosure is described in the following. Since the electronic control system concerning the fourth embodiment is configured just like the electronic control system concerning the first embodiment, the description about configuration is omitted from the fourth embodiment.

According to the first embodiment mentioned above, the mechanical switch is provided in the dedicated connector 40 for detecting whether the external device is connected to the dedicated connector 40 or not. In contrast, in the present embodiment, no such mechanical switch is provided. That is, without using a switch, detection of a connection of the external device to the dedicated connector 40 is enabled in the present embodiment.

Figure 5:
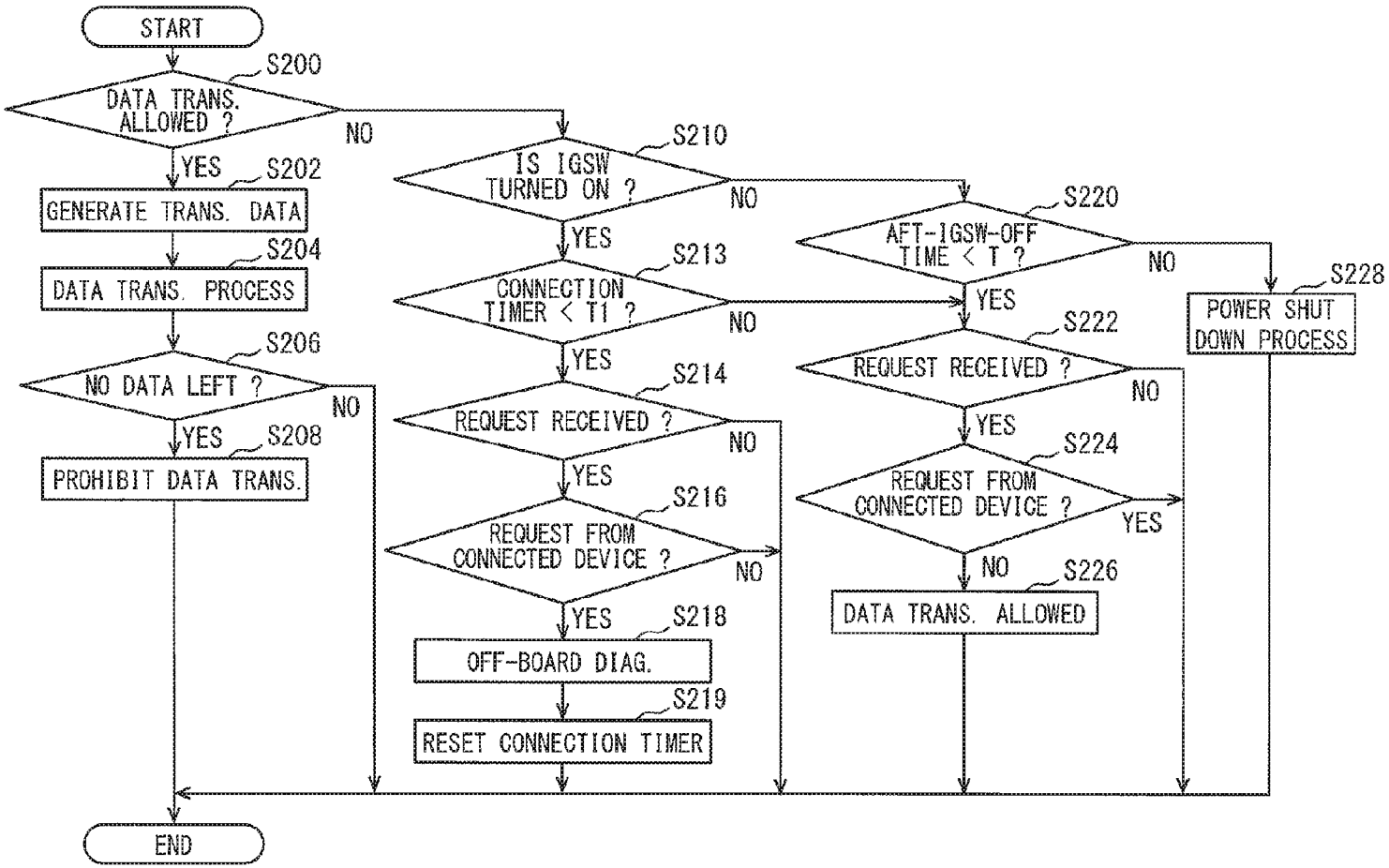
FIG. 5 is a flowchart of the arbitration process for arbitrating the off-board diagnosis process and the transmission process of the diagnosis data in a fourth embodiment of the present disclosure.

As specifically shown in Step S219 of the flowchart in FIG. 5, a connection timer for detecting a connection of the external device is provided, and, when the request from the external device connected to the dedicated connector 40 is received and the off-board diagnosis process is performed, the connection timer is reset.

Then, as shown in Step S213, when a predetermined time T1 (e.g., 30 seconds) has lapsed without resetting based on the measurement of the connection timer, the connection of the external device to the dedicated connector 40 is detected as released.

In FIG. 5, a detection scheme for detecting a release (i.e., disconnection) of the external device by using the connection timer, which is applied to the process of ECU 10 in the third embodiment, is illustrated. However, such scheme may also be applicable to the process of ECU 10 in the first embodiment, or the process of ECU 10 in the second embodiment.

Although the present disclosure has been described in connection with preferred embodiment thereof with reference to the accompanying drawings, it is to be noted that various changes and modifications will become apparent to those skilled in the art, and such changes, modifications, and summarized schemes are to be understood as being within the scope of the present disclosure as defined by appended claims.

What is claimed is:

1. An electronic control device installed in a vehicle configured to control a transmission of vehicle diagnostic data to an external management center, the electronic control device comprising:

a microcomputer configured to interface with vehicle sensors and actuators to accumulate vehicle diagnostic data from the vehicle sensors and actuators and to store the vehicle diagnostic data into a memory in response to a request message from an external diagnostic device, wherein the microcomputer is further configured to detect an ON state and an OFF state of a vehicle ignition switch, and wherein when the microcomputer detects the OFF state of the vehicle ignition switch, the microcomputer is further configured to communicate with a power supply IC to maintain a power supply from a vehicle battery to the electronic control device via a power relay, and wherein the microcomputer is further configured to detect a connection of an external device or the external diagnostic device to a dedicated connector within the vehicle, and wherein when the microcomputer detects the ON state of the vehicle ignition switch and the connection of the external device or the external diagnostic device to the dedicated connector, the microcomputer refrains from sending the vehicle diagnostic data stored in the memory to a communication module for transmission to the external management center, and wherein when the microcomputer detects the OFF state of the vehicle ignition switch and the connection of the external device or the external diagnostic device to the dedicated connector, the microcomputer transmits the vehicle diagnostic data stored in the memory to the communication module for transmission to the external management center.

2. The electronic control device of claim 1, wherein in response to the microcomputer receiving a data transmission request from the external management center, the microcomputer transmits the vehicle diagnostic data stored in the memory to the communication module for transmission to the external management center.

3. The electronic control device of claim 2, wherein during the OFF state of the vehicle ignition switch, the data transmission request from the external management center is sent to the microcomputer via an output ECU in the vehicle.

4. The electronic control device of claim 1, wherein when the microcomputer detects the OFF state of the vehicle ignition switch, the microcomputer maintains the power supply from the vehicle battery to the electronic control device for a preset amount of time.

5. The electronic control device of claim 1, wherein when the microcomputer detects the OFF state of the vehicle ignition switch, the microcomputer maintains the power supply from the vehicle battery to the electronic control device and the communication module until the communication module transmits the vehicle diagnostic data to the external management center.

6. The electronic control device of claim 1, wherein the microcomputer is further configured to communicate with a mechanical switch of the dedicated connector to detect the connection of the external device or the external diagnostic device to the dedicated connector and to detect a disconnection of the external device or the external diagnostic device from the dedicated connector.

7. The electronic control device of claim 1, wherein the microcomputer is further configured to detect a disconnection of the external diagnostic device from the dedicated connector after a preset amount of time elapses after the microcomputer receives the request message from the external diagnostic device.

8. An electronic control system in a vehicle configured to control a transmission of vehicle diagnostic data to an external management center, the control system comprising:

a microcomputer configured to interface with vehicle sensors and actuators to accumulate vehicle diagnostic data from the vehicle sensors and actuators and to store the vehicle diagnostic data into a memory in response to a request message from an external diagnostic device;

a communication module configured to transmit the vehicle diagnostic data stored in the memory to the external diagnostic device; and a battery configured to supply power to the microcomputer and the communication module;

a power supply IC connected to the battery and in communication with the microcomputer, the power supply IC configured to output a signal to generate a current flow;

a power relay connected to the battery and the power supply IC, the power relay configured to switch ON and OFF in response to the current flow; and a dedicated connector disposed within the vehicle and in connection with the microcomputer, the dedicated connector configured to connect with an external device or the external diagnostic device, wherein the microcomputer is further configured to detect an ON state and an OFF state of a vehicle ignition switch, and wherein when the microcomputer detects the OFF state of the vehicle ignition switch, the microcomputer is further configured to communicate with the power supply IC to output the signal to generate the current flow to switch the power relay ON to maintain a power supply from the battery to the microcomputer and the communication module, and wherein the microcomputer is further configured to detect a connection of the external device or the external diagnostic device to the dedicated connector, and wherein when the microcomputer detects the ON state of the vehicle ignition switch and the connection of the external device or the external diagnostic device to the dedicated connector, the microcomputer refrains from sending the vehicle diagnostic data stored in the memory to the communication module for transmission to the external management center, and wherein when the microcomputer detects the OFF state of the vehicle ignition switch and the connection of the external device or the external diagnostic device to the dedicated connector, the microcomputer transmits the vehicle diagnostic data stored in the memory to the communication module for transmission to the external management center.

9. The electronic control device of claim 8, wherein the communication module transmits the vehicle diagnostic data stored in the memory to the external management center in response to the microcomputer receiving a data transmission request from the external management center.

10. The electronic control device of claim 9 further comprising:

an output ECU configured to send the data transmission request from the external management center to the microcomputer during the OFF state of the vehicle ignition switch.

11. The electronic control device of claim 8, wherein when the microcomputer detects the OFF state of the vehicle ignition switch, the microcomputer communicates with the power supply IC to maintain the power supply from the vehicle battery via the power relay to the microcomputer and the communication module for a preset amount of time.

12. The electronic control device of claim 8, wherein when the microcomputer detects the OFF state of the vehicle ignition switch, the microcomputer communicates with the power supply IC to maintain the power supply from the vehicle battery via the power relay to the microcomputer and the communication module until the communication module transmits the vehicle diagnostic data to the external management center.

13. The electronic control device of claim 8, wherein the dedicated connector includes a mechanical switch for detecting the connection of the external device or the external diagnostic device to the dedicated connector and for detecting a disconnection of the external device or the external diagnostic device from the dedicated connector.

14. The electronic control device of claim 13, wherein the microcomputer is further configured to detect the disconnection of the external diagnostic device from the dedicated connector after a preset amount of time elapses after the microcomputer receives the request message from the external diagnostic device.

* * * * *